United States Patent [19]

Gutman et al.

[11] 4,108,665

[45] Aug. 22, 1978

[54] STABILIZERS FOR PHOTOTHERMOGRAPHIC CONSTRUCTIONS

[75] Inventors: Gustav Gutman, Maplewood; Edward Goettert, Oakdale, both of Minn.

[73] Assignee: Minnesota Mining and Manufacturing Company, Saint Paul, Minn.

[21] Appl. No.: 730,678

[22] Filed: Oct. 7, 1976

[51] Int. Cl.[2] ..... G03C 1/02; G03C 5/30; G03C 5/24; G03C 1/34

[52] U.S. Cl. ..... 96/114.1; 96/66 T; 96/48 HD; 96/109

[58] Field of Search ..... 96/114.1, 109, 66 T, 96/48 HD

[56] References Cited

U.S. PATENT DOCUMENTS

| | | | |
|---|---|---|---|
| 3,305,361 | 2/1967 | Gaynor et al. | 96/48 HD |
| 3,589,901 | 6/1971 | Lyons | 96/114.1 |
| 3,707,377 | 12/1972 | Tiers et al. | 96/114.1 |

FOREIGN PATENT DOCUMENTS

| | | | |
|---|---|---|---|
| 1,110,046 | 4/1968 | United Kingdom | 96/114.1 |

*Primary Examiner*—Dennis E. Talbert, Jr.
*Assistant Examiner*—Louis Falasco
*Attorney, Agent, or Firm*—Cruzan Alexander; Donald M. Sell; Mark A. Litman

[57] ABSTRACT

Photothermographic materials may be stabilized by inclusion of compounds having terminal 1,1,1-tri bromoethoxy or 1,1,1-di bromochloroethoxy type groups.

5 Claims, No Drawings

STABILIZERS FOR PHOTOTHERMOGRAPHIC CONSTRUCTIONS

BACKGROUND OF THE INVENTION

Photothermographic sheet constructions usually comprise a light-insensitive silver source (e.g., an organic silver salt such as silver behenate or silver benzimidazole, or a complexed silver salt) in catalytic proximity to photographic silver halide. A thermographic developing agent, that is a reducing agent for silver ion, is also present in the construction. Light imaging generates a latent image on the silver halide material. This latent image is essentially the same as a latent image on conventional photographic processes and comprises stable groups of silver metal atoms formed on the silver halide by the action of the imaging light. It is well known that the presence of silver metal is autocatalytic to the reduction of silver ions in electronic proximity (near enough to allow electron transfer) to the silver metal. The formation of the latent image on the silver halide thus generates catalytic silver sites which are in catalytic proximity to the thermographically developable silver source and will catalyze the thermographic reaction. Upon heating the sheet with these catalytic silver sites present therein, thermographic development (reduction of the silver source by the reducing agent for silver ions under the impetus of heat) occurs very rapidly about the catalytic sites and very slowly, if at all, where the silver source is not catalytically activated. A negative image is thus produced, with optical densities generated in light struck areas.

A significant problem with this technology has been the fact that the silver halide, silver source, and reducing agent in non-light struck areas still remain active in the sheet after thermographic development. After prolonged exposure of the final photothermographic image to light, the silver halide will have been converted almost completely to silver metal and catalytic sites will be present over the entire sheet. Even at room temperature, the presence of the catalytic sites will be sufficient to cause the non-imaged background areas to progressively generate a spurious image. This spurious image is formed by the slow activity of the reducing agent acting at ambient temperatures on the catalyzed silver source. Theoretically, the entire sheet would eventually darken completely, destroying the original image. In fact, photothermographic sheets do show intolerable rises in Dmins and general discoloring after years of prolonged and intense exposure to radiation.

Previous attempts have been made to stabilize the final photothermographic silver image, but these attempts have met with mixed success. U.S. Pat. No. 3,707,377, for example, disclosed the use of halogen containing organic compounds as dry silver stabilizers. A test was presented for distinguishing useful halogen containing compounds from useless materials. This test characterization proved to be wrong, with significant numbers of useful halogen containing organic compounds excluded by the test and numerous otiose materials included by the test definition. Although the actual compounds tested in that patent performed properly according to that test, extrapolation beyond those compounds proved to be an error. The degree of stabilization provided by those compounds was also not as great as desired.

U.S. Pat. No. 3,874,946 shows the use of a tribromomethane sulfonylbenzthiazole as a stabilizer for dry silver sheet. This compound generally works well as a stabilizer in photothermographic constructions, the benzthiazole radical being well known as a photographic stabilizer.

THE INVENTION

It is one aspect of the present invention to provide new stabilizers for photothermographic constructions.

It is another aspect of the present invention to provide stabilizers for photothermographic constructions which are incorporated into photothermographic sheets.

The sensitizers of the present invention may be represented by the formula:

$$CRBr_2CR^1R^2R^3$$

wherein

R is Br or Cl, $R^1$ is independently H, alkyl, phenyl, or naphthyl, $R^2$ is independently H, alkyl or phenyl, and $R^3$ is OH, alkoxy, trihydrocarbylsiloxy, carbamate, sulfonate, carbonate, phosphate or carboxylate.

Preferred compounds are of the formula:

$$CBr_3CH_2R^3$$

wherein $R^3$ is as defined above.

These compounds may be added at any time to the photothermographic construction to stabilize the image, but are best added into the original construction of the sheet during coating of the emulsion.

The term carbamate as used in the practice of this invention refers to a group attached to the 1-carbon atom through the oxygen bond of the group $$-\overset{\overset{\displaystyle O}{\|}}{O}\overset{\overset{\displaystyle H}{|}}{C}N-.$$

Preferably an aryl, alkyl, alkenyl, or heterocyclic group completes the valence requirements of the nitrogen atom in the carbomate group. Alkyl includes straight, branched and cyclic alkyl groups. Aryl and alkyl groups are most preferred, having no more than 20 to 30 carbon atoms respectively.

Similarly the terms sulfonate $$(-\overset{\overset{\displaystyle O}{\|}}{O}\underset{\underset{\displaystyle O}{\|}}{S}-),\ \text{carbonate}\ (-O-\overset{\overset{\displaystyle O}{\|}}{C}-O-),$$

$$\text{phosphate}\ (-O\underset{\underset{\displaystyle O}{\|}}{P}O-),\ \text{and carboxylate}\ (-O\overset{\overset{\displaystyle O}{\|}}{C}-)$$

refer to groups attached through the respective bridging moieties and bonded to the 1-carbon atom of the structural formula through an available oxygen bond of the respective moiety. Aryl of no more than 20 carbon atoms is most preferred for sulfonate groups, and aryl, alkyl, alkenyl and heterocyclic groups (5-, 6-, or 7-membered rings of C, N, O, and S ring atoms only) are preferred groups for the remaining bridging moieties.

The ordinarily skilled photothermographic artisan would realize the inherent limitation on the scope of these groups in excluding such terminating groups as are known to increase development in non-imaged areas by providing active development functionality. Such groups would be phenols and primary amines which are known active developers and which would not be suitable as substituents in the practice of the present invention. Excepting this limitation, the terminating portion of the compounds of this invention is not critical. Only preferences are displayed in the practice of this invention by alteration of the end group structure, all inactive development end groups displaying a stabilizing capability.

Although 2,2,2-tribromoethanol is less reactive than ethanol in nucleophilic reactions, its derivatives can be made in a similar manner to those of ethanol utilizing synthetic procedures that are commonplace to those skilled in the art. For example, urethanes are made by condensation of isocyanates and tribromoethanol in a suitable solvent; and esters are made by the condensation of carboxylic acid halides and tribromoethanol. All the materials may be made by condensation of the appropriate reactants. Some of these materials have been made in the prior art by these processes.

The stabilizers of this invention are found to perform well in all types of photothermographic constructions, on coated paper, on transparent film, with long chain fatty acid silver salt sources (e.g., silver behenate), thermographically developable silver salts (e.g., silver benzimidazole) and complexed silver salts (e.g., U.S. application Ser. No. 659,839, filed Feb. 20, 1976), and with in situ halidization (U.S. Pat. No. 3,457,075) or preformed silver halide (U.S. Pat. No. 3,839,049). The use of stabilizers of the present invention has been found to be compatible with other photothermographic additives such as toning agents and reducing agents disclosed in U.S. Pat. Nos. 3,392,020; 3,446,648; 3,667,958; 3,667,959; 3,672,904; 3,679,426; 3,751,249; 3,751,252; 3,751,255; 3,801,321 and British Pat. Nos. 1,163,187; 3,782,941 and 3,794,448. Sensitizers and sensitizing dyes as disclosed in U.S. Pat. Nos. 3,679,422; 3,666,477; 3,761,279 and 3,719,495 are also useful, as are such materials described as image amplifiers (U.S. Pat. No. 3,708,304), color couplers (U.S. Pat. No. 3,531,286), development inhibitor releasing compounds (U.S. Pat. No. 3,700,457), decolorizable light absorbers (U.S. Pat. No. 3,745,009), mercury compounds (U.S. Pat. No. 3,589,903), etc. Processes and structures described in U.S. Pat. Nos. 3,748,137; 3,761,270; 3,764,328; 3,764,329; 3,769,019; 3,589,901; 3,152,904; (Re. 26,719); 3,607,282; 3,685,993; 3,679,414; 3,218,166 and 3,756,829 are also contemplated in the practice of the present invention.

Further understanding of the present invention will be enabled by a reading of the following Examples.

EXAMPLES

A control or standard photothermographic emulsion was constructed to provide an appropriate environment for evaluation of the stabilizers of the present invention. The control was constructed as follows.

A homogenous mixture of 27.6 g silver behenate, 2.0 ml N-methyl-2-pyrolidone (sensitizer), and 3.0 g polyvinyl butyral in 172.4 g of a solvent solution (68:25:7) of methylethyl ketone, toluene, and methylisobutyl ketone was mixed for 20 minutes with 0.48 g of tetrachlorophthalic anhydride in 12 ml of (1:1 by volume) methylethyl ketone and methanol. This was then mixed with 33 g of polyvinyl butyral and then 3.3 ml of a mercury bromide solution (10 g $HgBr_2$/100 ml methanol. To this was further added 2.6 ml of a sensitizing dye solution in methanol, the dye having the mixture

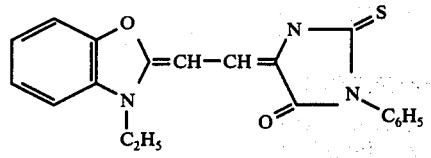

and the solution having 0.262 g dye/100 ml methanol.

This final mixture was knife-coated on polyester film base at a 4 mil wet coating thickness then forced air dried at 180° F (81° C) for 4 minutes.

The second trip coating of the control comprised 200 ml methylethyl ketone, 13.0 g cellulose acetate, 0.6 g phthalazine (toner), 2.0 g 2,2'-methylene-bis-(4-ethyl-6-tertbutyl phenol), 2.0 g bis [2,2'-dihydroxy-3,3',5,5'-tetramethyl diphenyl]-[2,4,4-trimethoxy pentyl]methane, 18.0 ml methanol, 18.0 ml acetone, and 0.5 g 4-methyl phthalic acid.

A control photothermographic construction (without stabilizer) was formed by coating this second final mixture over the already coated polyester base. The second coating was also knife-coated at a 4 mil wet coating thickness and dried at 180° F (81° C) for 3 minutes. Imaging was performed by exposure to a tungsten light source and heat-processing in an inert fluorocarbon bath for 20 seconds at 260° F. The imaged film strips were then exposed to 1000 foot candles for 24 hous under a fluorescent lamp. The Dmin for each samples was measured before and after exposure to the fluorescent light.

In the compared photothermographic constructions, different amounts of stabilizer were added to the second coating prior to its application to the already coated polyester sheet. The results are tabulated below.

| Compound | Moles | Conc. (% wt.) | Dmin (Initial) | Dmin (Final) |
|---|---|---|---|---|
| None | — | — | .07 | .20 |
| 2,2,2-tribromoethanol | .0011 | 0.3 | .06 | .08 |
| | .00007 | 0.02 | .06 | .16 |
| | .0071 | 2.0 | .07 | .07 |
| 2,2,2-tribromoethyl cyclohexanecarbamate | .0015 | 0.6 | .07 | .10 |
| 2,2,2-tribromoethyl benzenecarbamate | .0015 | 0.6 | .06 | .08 |
| 2,2,2-tribromoethyl benzoate | .0016 | 0.6 | .06 | .12 |
| 2,2,2-tribromoethyl ethylcarbonate | .0017 | 0.6 | .09 | .11 |

Materials of similar structure but having perchloro groups in place of the perbromo groups were investigated but found to have insignificant effects upon stability.

| Compound | Moles | Conc. (% wt.) | Dmin (Initial) | Dmin (Final) |
|---|---|---|---|---|
| 2,2,2-tribromoethanol | .0141 | 4.0 | .06 | .09 |
| 1,1,1-trichloropropanol-2 | .0012 | 0.2 | .06 | .18 |
| 1,1,1-trichloropropanol-2 | .0122 | 2.0 | .07 | .24 |
| 2,2,2-trichloroethanol | .0013 | 0.2 | .06 | .20 |
| 2,2,2-trichloroethanol | .0134 | 2.0 | .07 | .22 |

A second control emulsion was formulated as above to evaluate further stabilizers of this invention. The results are tabulated below:

| Compound | Moles | Conc. (% wt.) | Dmin (Initial) | Dmin (Final) |
|---|---|---|---|---|
| Control | — | — | .08 | .46 |
| 2,2-dibromo-2-chloro-1-phenylethanol | .003 | 1.0 | .08 | .15 |
| tribromoethyl-cinnamate | .002 | 1.0 | .08 | .16 |
| 2-methyl-1,1,1-tribromo-2-propanol | .003 | 1.0 | .08 | .13 |
| Bis(2,2,2-tribromoethoxy)diphenylmethane | .0014 | 1.0 | .07 | .19 |

A third control emulsion was formulated as above. The results are as follows:

| Compound | Moles | Conc. (% wt.) | Dmin (Initial) | Dmin (Final) |
|---|---|---|---|---|
| Control | — | — | .08 | .28 |
| p-toluenesulfonyl tribromoethyl urethane | .010 | 0.5 | .08 | .26 |

A fourth control emulsion was formulated as above. The results are as follows:

| Compound | Moles | Conc. (% wt.) | Dmin (Initial) | Dmin (Final) |
|---|---|---|---|---|
| Control | — | — | .06 | .17 |
| 2,2,2-tribromoethyl stearate | .0004 | 0.2 | .09 | .09 |
| | .0018 | 1.0 | .07 | .11 |
| | .0054 | 3.0 | .09 | .11 |

A fifth control emulsion was formulated as above. The results are as follows:

| Compound | Moles | Conc. (% wt.) | Dmin (Initial) | Dmin (Final) |
|---|---|---|---|---|
| Control | — | — | .07 | .21 |
| 2,2,2-tribromoethyl-2-furoate ($Br_3CCH_2OCO$ 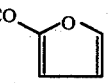 ) | .0013 | 0.5 | .09 | .10 |
| Bis(2,2,2-tribromoethyl) succinate | .0008 | 0.5 | .09 | .12 |
| 2,2,2-tribromoethyl benzenesulfonate | .0011 | 0.5 | .07 | .08 |
| 2,2,2-tribromoethoxy-trimethyl silane | .0014 | 0.5 | .08 | .11 |
| 2,2,2-tribromo-1-phenylethanol | .0056 | 2.0 | .08 | .06 |

A sixth control emulsion was formulated as above. The results are as follows:

| Compound | Moles | Conc. (% wt.) | Dmin (Initial) | Dmin (Final) |
|---|---|---|---|---|
| Control | — | — | .08 | .25 |
| 2,2,2-tribromoethyl diphenylphosphate | .006 | 3.0 | .08 | .08 |

The above examples show a general stabilizing effect for all derivatives of 2,2-dibromo-2-chloroethanol and 2,2,2-tribromoethanol derivatives. The variation in the sensitometric properties of the different controls is the result of irregularities produced by small batch processing. In all instances, however, the compounds of this invention displayed measurable stabilizing functionality.

Although manufacture of compounds of the present invention is well within the skill of the artisan, as described above, the following two examples describe specific processes for synthesizing these compounds.

Preparation of 2,2,2-tribromoethyl cyclohexylurethane — Typical Urethane Preparation To a solution of 5.6 g of 2,2,2-tribromoethanol in 8 ml of toluene was added 2.5 g of cyclohexyl isocyanate and 1 drop of triethylamine. The resultant solution was allowed to stand at room temperature for several days until a significant amount of white precipitate had formed. The white precipitate was isolated by filtration and washed with cold toluene to give the urethane derivative of 2,2,2-tribromoethanol.

Preparation of 2,2,2-tribromoethyl stearate — Typical Ester Preparation 28.27 g of 2,2,2-tribromoethanol was dissolved in dichloromethane and 7.9 g of pyridine was added as one portion. To this mixture was added 30.3 g of stearoyl chloride. The resultant mixture was allowed to stand overnight during which time a white precipitate had formed. The precipitate was removed by filtration, and the dichloromethane solution was washed once with saturated aqueous $NaHCO_3$ and twice with water then dried (with $Na_2SO_4$). Removal of the dichloromethane under reduced pressure gave the ester as white crystals that could be purified by recrystallization from a hexane-ethyl acetate solution.

As shown by the above examples, a wide latitude in the concentration of the stabilizers is useful. Both lower and upper limits are difficult to fix as exact values. In a commercial embodiment it is believed that the stabilizers should be present in a range of 0.02 to 5.0% by weight of the imaging layer (the photothermographic emulsion layer). A preferred range would be 0.05 to 4.0% by weight of the emulsion layer.

Conventional thermographic and photothermographic binder materials are useful in the practice of this invention. Such transparent binders are usually natural resins, synthetic polymers, or mixtures thereof such as gelatin, polyvinyl butyral, cellulosic esters, polyesters, vinyl resins, carbonates, acrylic resins, or any other of the many known polymers known in the art as useful in photothermographic sheets.

The molecular weight of substituents on the stabilizers is believed to be without criticality to the functionality of the tribromoethanol derivatives of the present invention, with even the stearic acid derivative showing excellent properties. The provision of limitations on the size and weight of these terminating groups is therefore based upon economic and rational imitations as opposed to functional requirements. Alkyl groups, for example, as described for $R^1$, $R^2$, and $R^3$ may be of any size. One would choose to limit the size only because it is unnecessary to make the stabilizer larger. Such characteristics as solvency and non-diffusiveness within the emulsions are known to be affected by the character and size of terminating groups without affecting the utility of the materials. The preferred size ranges now described are to be considered in this light.

The alkyl and alkoxy groups described for $R^1$, $R^2$, and $R^3$ are preferred to have no more than 30 carbon atoms. Such well known and accepted substituents on these groups (alkyl, alkoxy, aryl, heterocyclic or alkenyl) as are known in the art to be acceptable on additives to photographic and photothermographic systems such as halogen atoms, cyano groups, sulfonic acid groups, carboxylic acid groups, alkyl or alkoxy groups (e.g., as additions on aryl or heterocyclic groups) may be present without affecting the utility of the stabilizers. Such groups could be used, for example, to adjust solvency characteristics to make the stabilizers more compatible with particular binders as would be readily understood by the ordinarily skilled artisan.

Similarly the phenyl, naphthyl, aryl, alkenyl, hydrocarbyl, and heterocyclic groups have no critical size limitations with regard to functionality. Size limitations are presented only as rational preferences, not functional necessities. The aryl groups may have aliphatic substituents thereon (as to form either alkaryl or arylalkyl groups) and the ring may have those substituents described above which are generally considered innocuous or beneficial. In general, aryl groups would preferably have no more than 30 carbon atoms merely to reduce the weight of materials added. No more than 20 carbon atoms in the aryl group would be more preferred, and phenyl and naphthyl most preferred. Accordingly, alkenyl preferably have no more than 30, and more preferably at most 20 or 10 carbon atoms. Heterocyclic rings of 5, 6, or 7 atoms (of only C, N, O, and S ring members) are contemplated and preferably contain only one heterocyclic ring and no more than one fused phenyl ring attached thereto (e.g., benzothiazole). Total atoms (excluding H) should be no more than 20 atoms in the heterocyclic group, including substituent groups like those previously discussed.

What is claimed is:

1. A photothermographic imaging layer comprising a reducible silver source, photographic silver halide in catalytic proximity to said silver source, a reducing agent for silver ion, and a binder, said imaging layer being further characterized by the presence of a stabilizing amount of at least one compound selected from $$CRBr_2CR^1R^2R^3$$

wherein

R is Br or Cl, $R^1$ is independently H, alkyl, phenyl, or naphthyl, $R^2$ is independently H, alkyl or phenyl, and $R^3$ is OH, alkoxy, trihydrocarbylsiloxy, carbamate, sulfonate, carbonate, phosphate, or carboxylate.

2. The imaging layer of claim 1 wherein said at least one compound is selected from $$CBr_3CH_2R^3$$

and $$\begin{array}{l} R^2CH-R^3 \\ \quad\;\; | \\ \quad\;\; CBr_3 \end{array}$$

wherein $R^2$ and $R^3$ are as defined above.

3. The imaging layer of claim 2 wherein said at least one compound is selected from $$CBr_3CH_2R^3$$

wherein $R^3$ is as defined above.

4. The imaging layer of claim 3 wherein said at least one compound is 2,2,2-tribromoethanol.

5. The imaging layer of claim 1 wherein said at least one compound is present in an amount constituting 0.025 to 3% by weight of the imaging layer.

* * * * *